US011174680B2

(12) United States Patent
Aros

(10) Patent No.: US 11,174,680 B2
(45) Date of Patent: Nov. 16, 2021

(54) PRESSURIZED FLUID FLOW SYSTEM HAVING MULTIPLE WORK CHAMBERS FOR A DTH HAMMER AND NORMAL CIRCULATION HAMMER THEREOF

(71) Applicant: Jaime Andres Aros, Santiago (CL)

(72) Inventor: Jaime Andres Aros, Santiago (CL)

( * ) Notice: Subject to any disclaimer, the term of this patent is extended or adjusted under 35 U.S.C. 154(b) by 0 days.

(21) Appl. No.: 16/771,725

(22) PCT Filed: Dec. 13, 2017

(86) PCT No.: PCT/CL2017/050076
§ 371 (c)(1),
(2) Date: Jun. 11, 2020

(87) PCT Pub. No.: WO2018/107305
PCT Pub. Date: Jun. 21, 2018

(65) Prior Publication Data

US 2020/0370373 A1 Nov. 26, 2020

(51) Int. Cl.
*E21B 1/26* (2006.01)
*E21B 4/14* (2006.01)
*E21B 10/38* (2006.01)

(52) U.S. Cl.
CPC ..... *E21B 4/14* (2013.01); *E21B 1/26* (2020.05); *E21B 10/38* (2013.01)

(58) Field of Classification Search
CPC ..... E21B 1/00; E21B 1/12; E21B 1/24; E21B 1/26; E21B 4/14
See application file for complete search history.

(56) References Cited

U.S. PATENT DOCUMENTS 4,583,601 A 1/1986 Freres
5,407,021 A * 4/1995 Kane ..... E21B 4/14 175/296
5,915,483 A 6/1999 Gien
5,992,545 A 11/1999 Ekwall
8,640,794 B2 * 2/2014 Aros ..... E21B 10/38 175/296
9,016,403 B2 * 4/2015 Aros ..... E21B 4/14 175/296

(Continued)

FOREIGN PATENT DOCUMENTS

WO 2014/207163 A2 12/2014

*Primary Examiner* — Jennifer H Gay
(74) *Attorney, Agent, or Firm* — Hoglund & Pamias, PSC; Roberto J. Rios

(57) ABSTRACT

A pressurized fluid flow system for a down the hole drill hammer has main and auxiliary chambers that exert work on the piston. The auxiliary chambers are formed around respective waists on the piston and externally delimited by respective cylinders which are arranged longitudinally in series. A set of supply chambers filled with the pressurized fluid are defined by annular recesses in the external surface of the piston for supplying said fluid to the chambers. Supply channels and discharge channels are formed in between the outer casing and the cylinders for respectively supply pressurized fluid through exit ports in the cylinders to the supply chambers and emptying the chambers through discharge ports in the cylinders. The supply and discharge of the chambers is controlled in a cooperative way by the piston and the cylinders. A normal circulation drill hammers is provided having this system.

2 Claims, 5 Drawing Sheets

(56) References Cited

U.S. PATENT DOCUMENTS

| | | | | |
|---|---|---|---|---|
| 10,316,586 | B1 * | 6/2019 | Aros | E21B 4/14 |
| 2002/0014354 | A1 * | 2/2002 | Patterson | E21B 7/068 175/57 |
| 2009/0188723 | A1 * | 7/2009 | Aros | E21B 4/14 175/296 |
| 2010/0012380 | A1 * | 1/2010 | Swadi | E21B 34/14 175/57 |
| 2011/0209919 | A1 * | 9/2011 | Aros | E21B 10/38 175/296 |
| 2013/0233626 | A1 * | 9/2013 | Aros | E21B 4/14 175/296 |
| 2014/0076638 | A1 * | 3/2014 | Aros | E21B 49/005 175/296 |
| 2015/0129316 | A1 | 5/2015 | Harrington et al. | |
| 2016/0340983 | A1 | 11/2016 | Bruandet | |
| 2020/0190906 | A1 * | 6/2020 | Bruandet | E21B 10/38 |
| 2020/0370373 | A1 * | 11/2020 | Aros | E21B 10/38 |

* cited by examiner

PRESSURIZED FLUID FLOW SYSTEM HAVING MULTIPLE WORK CHAMBERS FOR A DTH HAMMER AND NORMAL CIRCULATION HAMMER THEREOF

STATE OF THE ART

There are many different down the hole (DTH) drill hammers available for drilling in mining, civil works and in the construction of water, oil and gas and geothermal wells. These hammers are powered by pressurized fluid that is alternatively directed by different means into a lifting chamber and a drive chamber, which are located at opposite ends of the hammer piston. As one chamber is being filled with pressurized fluid, the other is being emptied and the difference in pressure between the lifting and drive chambers causes the reciprocating movement of the piston and the impact of the same on the drill bit with each working stroke of the piston.

Most of the known DTH drill hammers have only one drive chamber and one lifting chamber. In such cases, the piston has only one drive area and one lifting area. However, for increasing the effective thrust areas (i.e. drive area and lifting area) a number of DTH drill hammers make use of more than two chambers for moving the piston, three examples of which are described below.

U.S. Pat. No. 5,915,483

The normal circulation drill hammer design described in this patent has a centrally-bored piston shaped to provide an additional drive chamber and an additional lifting chamber between the piston and the inner wall of the outer casing of the hammer. These two additional chambers are created by recesses on the outer diameter of the piston and separated by a partition member.

For controlling the flow of pressurized fluid in and out of the chambers, a control rod is provided that extends from the backhead or rear sub of the hammer axially down the central bore of the piston, the control rod having one longitudinally extending supply passage and one longitudinally extending discharge passage. Ports in the control rod and piston respectively connect these passages with the lifting and drive chambers when the ports in the control rod are aligned with the ports in the piston during the reciprocating movement of the latter.

The main drive chamber is continuously connected to the source of pressurized fluid and from there the pressurized fluid is conveyed to the longitudinal supply passage of the control rod for alternately supplying the additional lifting and drive chambers with pressurized fluid, controlled by the relative position of the piston with the control rod.

The discharge of pressurized fluid from the main lifting chamber is controlled by the relative position between the piston and either a foot valve or an extended control rod, while the discharge from the additional lifting and drive chambers is controlled by the relative position of the piston and the control rod.

One disadvantage of this design is that the pressure in the main drive chamber is equal in average to the supply pressure of the working fluid, which means that the work exerted by the pressurized fluid over this region of the piston is null, so that the power of the hammer is negatively affected. Another disadvantage is the cross-sectional area occupied by the control rod, resulting in reduced front and rear thrust areas.

U.S. Pat. No. 5,992,545

This patent describes a normal circulation drill hammer design where the piston comprises a forward piston head, a rearward piston head provided with a main drive area, and a waist between the piston heads. An intermediate wall is arranged around the waist of the piston so that two chambers are formed on each side of the intermediate wall between the piston's waist and front and rear linings disposed in the housing of the hammer. A pin is arranged through the intermediate wall in order to lock the linings in fixed angular positions relative to the intermediate wall.

In between the front and rear linings and the housing there are disposed respective channels. The first of these channels is connected through radial holes in the rear lining with a room rearward of the piston which is continuously connected to the source of pressurized fluid. The second of these channels is connected with a space in the front end of the piston where the forward piston head is located and a main lifting area is defined.

The chamber formed between the forward piston head and the intermediate wall is continuously connected with the channel between the rear lining and the housing via a first channel in the intermediate wall and holes in the rear lining, thus said chamber being continuously filled with pressurized fluid from the source of such fluid. The chamber between the rearward piston head and the intermediate wall is connected via a second channel in the intermediate wall to the channel between the front lining and the housing and therefrom with the space in the front end of the piston.

The supply of pressurized fluid to the room where the main drive area is located, inside the rearward piston head, is controlled by a valve part arranged on a tube that is connected to the hammer string, said tube having holes open to the room. The discharge of said room is controlled by the overlap of the inner surface of the piston with radial holes in said tube, said radial holes conveying the pressurized fluid through the a central channel in the piston to a flushing hole of the drill bit. A foot valve is used for controlling the discharge of the space in the front end of the piston.

The supply of pressurized fluid to the space in the front end of the piston is controlled by the relative position of the outer surface of the piston and the inner surface of the front lining.

Since in this design the chamber formed between the forward piston head and the intermediate wall is continuously connected to the source of pressurized fluid, work exerted by this region of the piston is null.

U.S. Pat. No. 9,016,403

This patent describes a normal circulation drill hammer that has multiple chambers that exert work on a centrally bored piston, specifically one or more auxiliary drive and lifting chambers besides two main chambers located at opposite ends of the piston.

For controlling the supply of pressurized fluid to the chambers, the piston and a control tube coaxially arranged within the central bore of the piston cooperate to channel the pressurized fluid from internal chambers defined by recesses in the inner surfaces of the piston to the auxiliary chambers through ports machined in the piston and to the main chambers through passageways formed at each end of the piston between the control tube and the same piston.

For controlling the discharge of pressurized fluid from the chambers, the piston and a set of cylinders cooperate to channel the pressurized fluid from the drive and lifting chambers to discharge chambers through discharge ports machined in the cylinders.

Despite the drill hammer described in this patent has the advantage of provided multiple drive and lifting chambers, this design has drawbacks. The ports and internal chambers machined in the piston affect its reliability.

Besides, the presence of a control tube reduces the effective thrust area that can be added, makes the piston slender and can cause alignment related problems as excessive friction; all these issues reduce the performance and reliability of the hammer.

OBJECTIVES OF THE INVENTION

The DTH drill hammers of the prior art described above have the drawback that they do not make an efficient use of the space inside the hammer to create additional drive and lifting chambers that actually exert work on the piston. Additionally, the pistons described therein have features that make them unreliable.

Therefore, due to the high costs of operating drilling equipment and the greater depths of the wells needed in some applications such as oil & gas, geothermal energy and minerals exploration, it would be desirable to have a pressurized fluid flow system for a DTH drill hammer that could incorporate the following improvements without affecting the useful life of the hammer:

- a greater pressurized fluid consumption and as a result a higher power and a greater penetration rate,
- a higher efficiency in the energy conversion process to provide an even higher power and even greater penetration rate,
- a higher reliability due to the absence of critical features in the piston body, and
- increased drilling capacity at greater depths.

It would also be desirable that, in terms of control of the state of the lifting and drive chambers, the pressurized fluid flow system of the invention could have application in both normal circulation DTH drill hammers and reverse circulation DTH drill hammers.

BRIEF SUMMARY OF THE INVENTION

In a first aspect of the invention, an improved pressurized fluid flow system for a down the hole drill hammer is provided, characterized by the presence of a plurality of chambers that exert work on the piston, namely, one or more auxiliary drive chambers and one or more auxiliary lifting chambers besides two main chambers located at opposite ends of the piston. These auxiliary chambers are each formed around respective waists machined around the piston and are externally delimited by respective cylinders, including at least one rearmost cylinder and one forwardmost cylinder. The cylinders are arranged longitudinally in series and coaxially disposed in between the outer casing of the hammer and the piston, the cylinders being separated from each other by seals and supported on the outer casing.

The pressurized fluid flow system of the invention is further characterized by having a set of supply chambers defined by annular recesses in the external surface of the piston, all the supply chambers being in fluid communication with the source of pressurized fluid and permanently filled with the same, for supplying the multiple drive and lifting chambers with said fluid.

The supply of pressurized fluid into said chambers is controlled in the invention in a cooperative way by the piston and the cylinders, specifically by the outer sliding surfaces of the piston and the inner surfaces of the cylinders.

A set of pressurized fluid intake ports is provided in the rearmost cylinder for allowing the pressurized fluid coming from said source of pressurized fluid flow into one or more supply channels formed in between the outer casing and the cylinders and to flow from there into the supply chambers through respective sets of exit ports in the cylinders.

In the invention, each of the cylinders has a front set of recesses and a rear set of recesses on its inner surface for connecting the supply chambers with the lifting chambers and with the drive chambers when these must be supplied with pressurized fluid.

The pressurized fluid flow system of the invention is also characterized by having one or more discharge channels formed in between the outer casing and the cylinders, the discharge channels being in fluid communication with the bottom of the hole drilled by the hammer for discharging pressurized fluid from the multiple drive and lifting chambers. For this purpose, sets of rear discharge ports and front discharge ports are provided in the cylinders for connecting the drive and lifting chambers with the discharge channels. In this manner, the discharge of pressurized fluid from the drive and lifting chambers is also controlled in a cooperative way by the piston and the cylinders, specifically by the outer sliding surfaces of the piston and the inner surfaces of the cylinders.

In a second aspect of the invention, a normal circulation DTH drill hammer is provided that is characterized by comprising the improved pressurized fluid flow system herein described and a drill bit guide with one or more apertures that connect the discharge channels with channels formed between the splines of the drill bit, the drill bit having flushing passages which connect these channels between the splines of the drill bit with the bottom of the hole.

To facilitate the understanding of the precedent ideas, the invention is hereinafter described making reference to the attached drawings.

Figure 1:
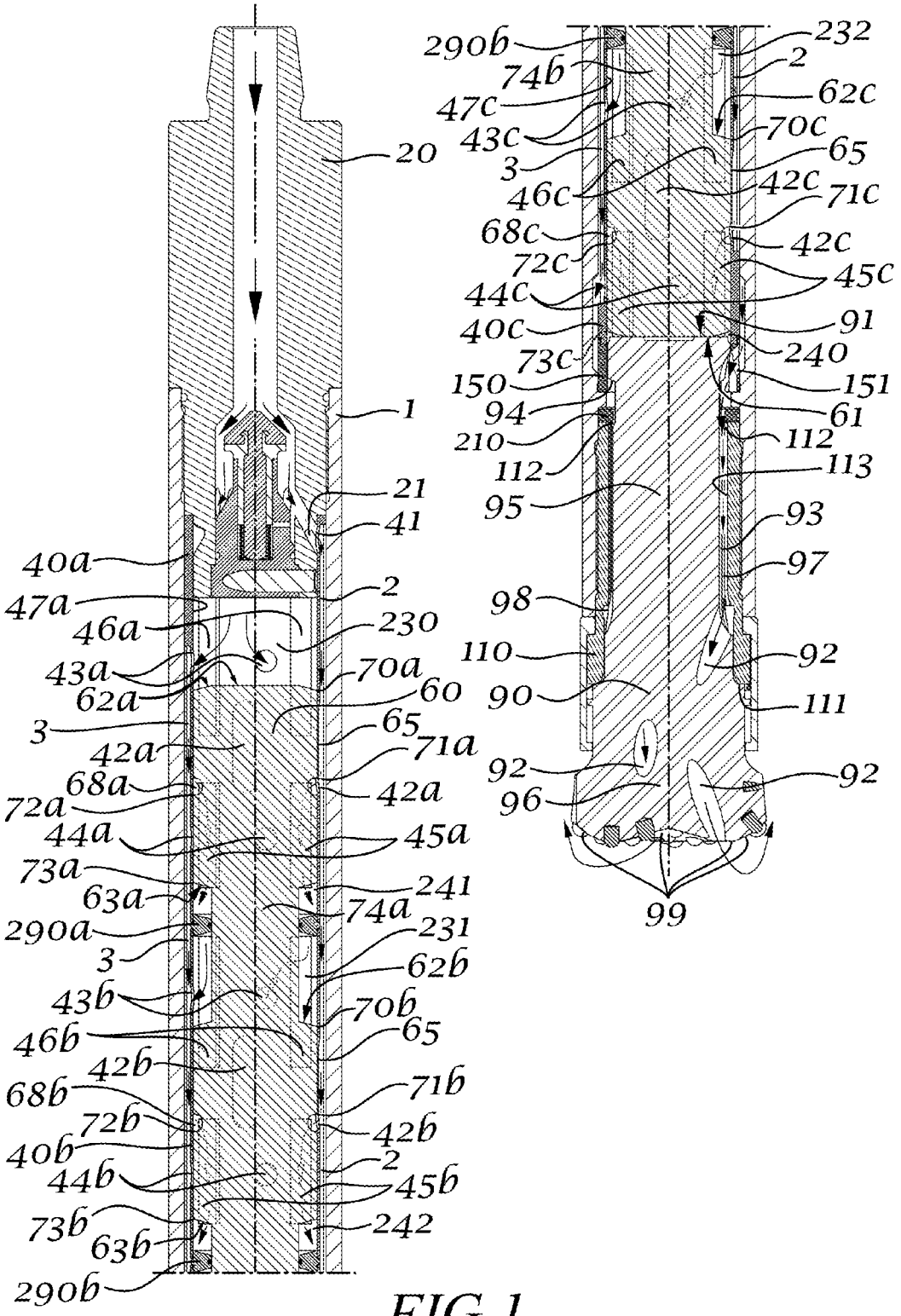
FIG. 1 depicts a longitudinal cross section view of a normal circulation DTH drill hammer according to the invention, the hammer comprising the improved pressurized fluid flow system of the invention, specifically showing the disposition of the piston with respect to the drill bit, cylinders and seals when the plurality of lifting chambers are being supplied with pressurized fluid and the plurality of drive chambers are discharging pressurized fluid to the bottom of the hole.
Figure 2:
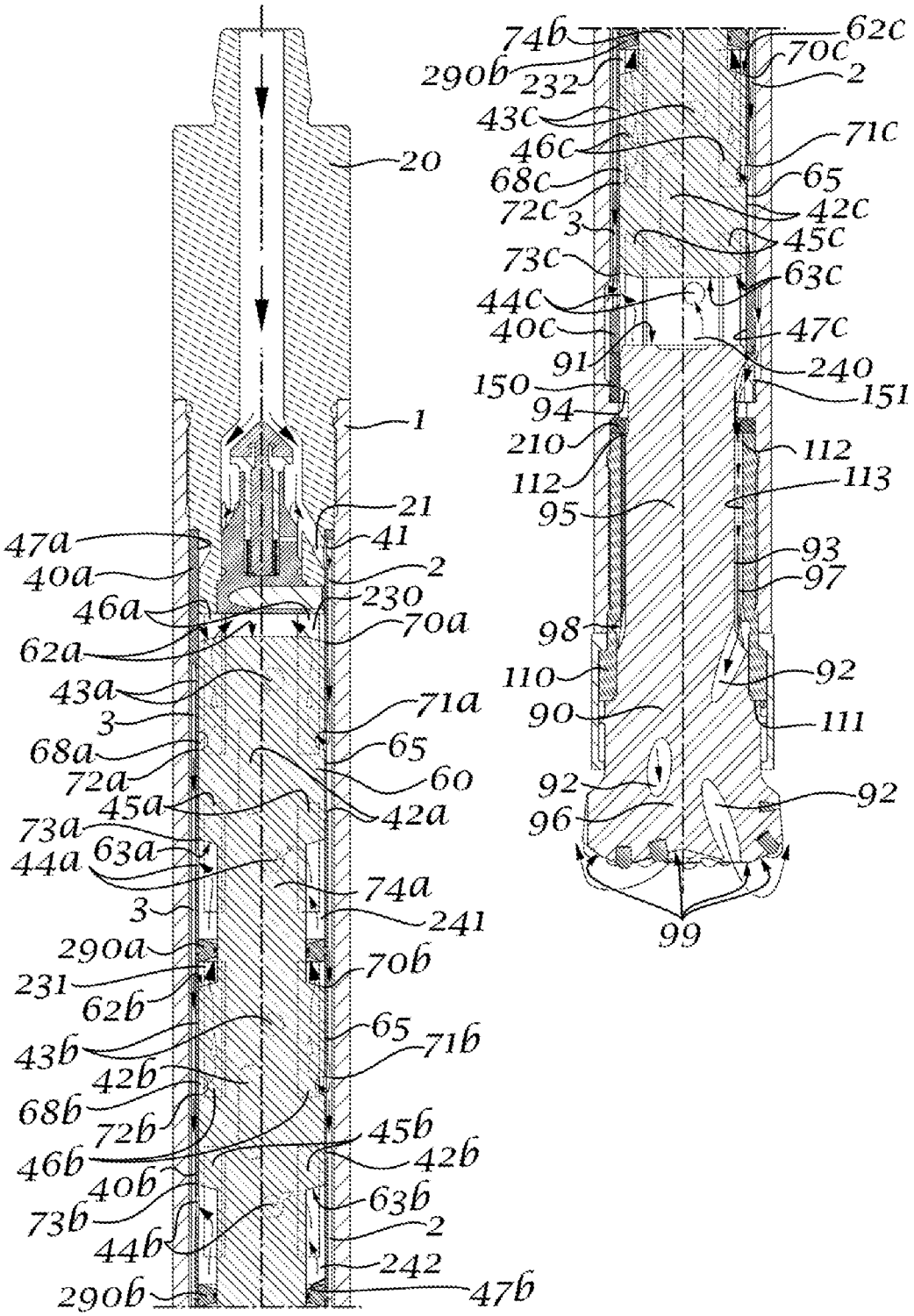
FIG. 2 depicts a longitudinal cross section view of a normal circulation DTH drill hammer according to the invention, the hammer comprising the improved pressurized fluid flow system of the invention, specifically showing the disposition of the piston with respect to the drill bit, cylinders and seals when the plurality of drive chambers are being supplied with pressurized fluid and the plurality of lifting chambers are discharging pressurized fluid to the bottom of the hole.
Figure 3:
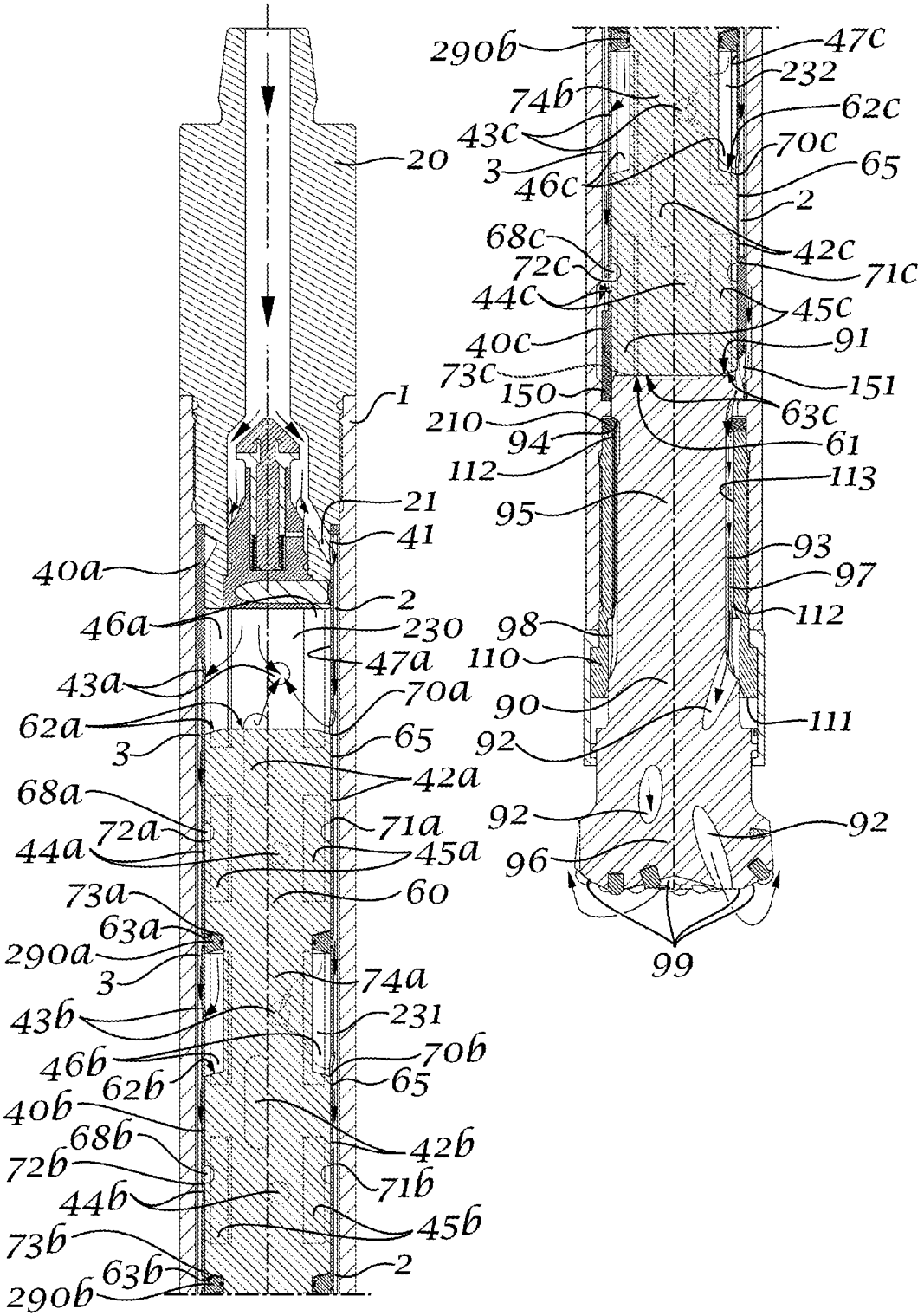
FIG. 3 depicts a longitudinal cross section view of the normal circulation DTH drill hammer according to the invention, the hammer comprising the improved pressurized fluid flow system of the invention, specifically showing the disposition of the piston with respect to the drill bit, cylinders and seals when the hammer is in flushing mode.
Figure 4:
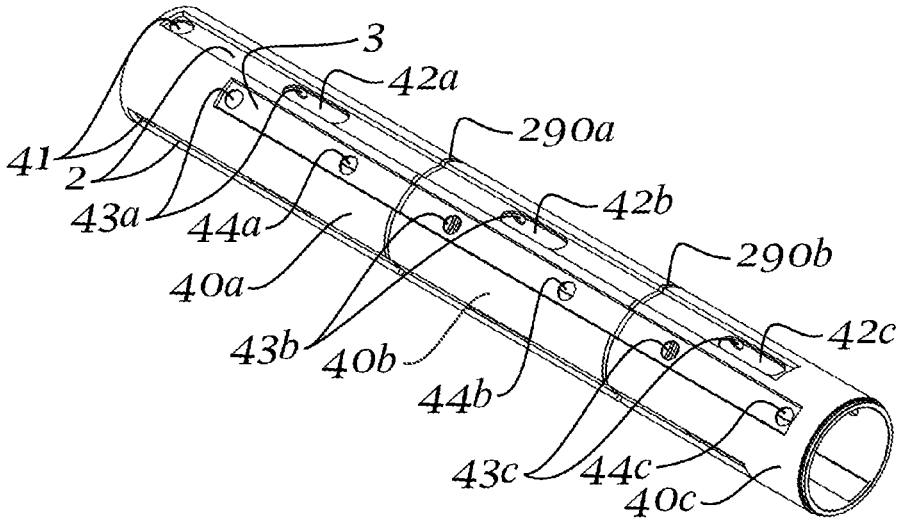
FIG. 4 depicts an isometric view of the cylinders and seals array of the improved pressurized fluid flow system of the invention.

The pressurized fluid flow system of the invention has been depicted in FIGS. 1, 2 and 3, as applied to a normal circulation DTH drill hammer, showing the solution designed under the invention to convey the pressurized fluid coming from the source of pressurized fluid to the supply channels and thence to the plurality of lifting chambers and drive chambers, and from these chambers to the discharge channels and therefrom to the bottom of the hole drilled by the hammer, in all modes and states of these chambers, including the exhaust of pressurized fluid to the front face of the drill bit for flushing the rock cuttings. In the figures, the direction of the pressurized fluid flow has also been indicated by means of arrows. However, a skilled person in the art will readily visualize how to apply the pressurized fluid flow system of the invention to a reverse circulation DTH hammer, since the pressurized fluid flow system is the same than that depicted for a normal circulation DTH hammer in FIGS. 1 to 3.

DETAILED DESCRIPTION OF THE INVENTION

Referring to FIGS. 1 to 6, the pressurized fluid flow system according to a preferred embodiment of the invention comprises the following main components:

a cylindrical outer casing (1) having a rear end and a front end;

a driver sub (110), mounted to said front end of the outer casing (1), and having an inner surface (113) with splines (112) machined thereon;

a rear sub (20) affixed to said rear end of the outer casing (1) for connecting the hammer to the source of pressurized fluid;

a piston (60) which is slidably and coaxially disposed to exert a reciprocating movement inside the outer casing (1); and a drill bit (90) slidably mounted on the driver sub (110), the sliding movement of the drill bit (90) limited by the drill bit retainer (210) and the drill bit supporting face (111) of the driver sub (110), the drill bit (90) comprised of a drill bit shank (95) at the rear end of the drill bit and a drill bit head (96) at the front end of the drill bit, the drill bit head (96) being of bigger diameter than the drill bit shank (95) and having a front face (99), the drill bit shank (95) having an outer surface (98) with splines (93) machined thereon, wherein the drill bit (90) is aligned with the outer casing (1) by means of a drill bit guide (150) disposed inside said outer casing (1).

As shown in these figures, the pressurized fluid flow system of the invention further comprises the following components:

a main lifting chamber (240) and a main drive chamber (230) located at opposites ends of the piston (60) for causing the reciprocating movement of the piston (60) due to the changes in pressure of the pressurized fluid contained therein;

a set of cylinders (40 *a*, 40 *b*, 40 *c*), in this case three cylinders and including at least one rearmost cylinder and one forwardmost cylinder, that are arranged longitudinally in series and are coaxially disposed between the outer casing (1) and the piston (60), the cylinders (40 *a*, 40 *b*, 40 *c*) being supported on the outer casing (1) and separated from each other by seals (290 *a*, 290 *b*), in this case two of them, the cylinders (40 *a*, 40 *b*, 40 *c*) having respectively inner (47 *a*, 47 *b*, 47 *c*) and an outer surfaces (48 *a*, 48 *b*, 48 *c*);

a set of auxiliary lifting chambers (241, 242) and auxiliary drive chambers (231, 232), in this case two of each, respectively located at each side of said seals (290 *a*, 290 *b*) and respectively formed by rear (74 *a*) and front (74 *b*) waists machined around the piston (60), for likewise causing the reciprocating movement of the piston (60) in conjunction with the main lifting and drive chambers (240, 230), due to the changes in pressure of the pressurized fluid contained therein;

a set of supply chambers (68 *a*, 68 *b*, 68 *c*) defined by annular recesses in the external surface (65) of the piston (60) in cooperation with the inner surfaces (47 *a*, 47 *b*, 47 *c*) of the cylinders (40*a*, 40 *b*, 40 *c*), the supply chambers (68 *a*, 68 *b*, 68 *c*) being in permanent fluid communication with the source of pressurized fluid and filled with the same;

one or more supply channels (2) formed in between the outer casing (1) and the cylinders (40 *a*, 40 *b*, 40 *c*) by a set of recesses in the outer surface of the cylinders (40 *a*, 40 *b*, 40 *c*), the supply channels (2) being in permanent fluid communication with the source of pressurized fluid;

one or more discharge channels (3) formed in between the outer casing (1) and the cylinders (40 *a*, 40 *b*, 40 *c*) by a set of recesses in the outer surface of the cylinders (40 *a*, 40 *b*, 40 *c*), the discharge channels (3) being in permanent fluid communication with the bottom of the hole; and channels (97) cooperatively formed between the splines (112) on the inner surface (113) of the driver sub (110) and the splines (93) on the outer surface (98) of the drill bit shank (95).

As can be noted, each of the cylinders (40 *a*, 40 *b*, 40 *c*) has respectively, a front set of recesses (45 *a*, 45 *b*, 45 *c*), and a rear set of recesses (46 *a*, 46 *b*, 46 *c*) on its inner surface for respectively connecting the supply chambers (68 *a*, 68 *b*, 68 *c*) with the lifting chambers (241, 242, 240) and with the drive chambers (230, 231, 232) when these must be supplied with pressurized fluid; a set of front discharge ports (44 *a*, 44 *b*, 44 *c*), and a set of rear discharge ports (43 *a*, 43 *b*, 43 *c*) bored therethrough for respectively discharging pressurized fluid from the lifting chambers (241, 242, 240) and drive chambers (230, 231, 232) to the discharge channels (3); a set of exit ports (42 *a*, 42 *b*, 42 *c*) for connecting the supply channels (2) with the supply chambers (68 *a*, 68 *b*, 68 *c*).

The precise boundaries of the different drive and lifting chambers are as follows:

- The main drive chamber (230) of the hammer is defined by the rear sub (20), the rear cylinder (40 *a*) and the main drive surface (62 *a*) of the piston (60).
- The first auxiliary drive chamber (231) is defined by the rear seal (290 *a*), the middle cylinder (40 *b*), the piston's rear waist (74 *a*) and the first auxiliary drive surface (62 *b*) of the piston (60).
- The second auxiliary drive chamber (232) is defined by the front seal (290 *b*), the front cylinder (40 *c*), the piston's front waist (74 *b*) and the second auxiliary drive surface (62 *c*) of the piston (60).
- The main lifting chamber (240) is defined by the drill bit (90), the drill bit guide (150), the front cylinder (40 *c*) and the main lifting surface (63 *c*) of the piston (60).
- The first auxiliary lifting chamber (241) of the hammer is defined by the rear seal (290 *a*), the rear cylinder (40 *a*), the piston's rear waist (74 *a*) and the first auxiliary lifting surface (63 *a*) of the piston (60).
- The second auxiliary lifting chamber (242) is defined by the front seal (290 *b*), the middle cylinder (40 *b*), the piston's front waist (74 *b*) and the second auxiliary lifting surface (63 *b*) of the piston (60).

The volumes of the drive chambers (230, 231, 232) and the lifting chambers (241, 242, 240) are variable depending on the piston's position.

Control of the State of the Lifting Chambers (241, 242, 240)

When in the hammer cycle the impact face (61) of the piston (60), which is part of the main lifting surface (63 *c*), is in contact with the impact face (91) of the drill bit (90) and the drill bit (90) is at the rearmost point of its stroke, i.e. the hammer is at impact position (see FIG. 1), the lifting chambers (241, 242, 240) are respectively in direct fluid communication with the supply chambers (68 *a*, 68 *b*, 68 *c*) through the front set of recesses (45 *a*, 45 *b*, 45 *c*) of the cylinders (40 *a*, 40 *b*, 40 *c*). In this way, the pressurized fluid is able to freely flow from the supply chambers (68 *a*, 68 *b*, 68 *c*) to the lifting chambers (241, 242, 240) and start the movement of the piston (60) in the rearward direction.

This flow of pressurized fluid to the lifting chambers (241, 242, 240) will stop when the piston (60) has traveled in the front end to rear end direction of its stroke until the point where the front outer supply edges (72 *a*, 72 *b*, 72 *c*) of piston (60) respectively reaches the rear limit of the front set of recesses (45 *a*, 45 *b*, 45 *c*) of the cylinders (40 *a*, 40 *b*, 40 *c*). As the movement of the piston (60) continues further in the front end to rear end direction of its stroke, a point will be reached where the front outer discharge edges (73 *a*, 73 *b*, 73 *c*) of the piston (60) will respectively match the front limit of the sets of front discharge ports (44 *a*, 44 *b*, 44 *c*) of the cylinders (40 *a*, 40 *b*, 40 *c*). As the movement of the piston (60) continues even further, the lifting chambers (241, 242, 240) of the hammer will respectively become fluidly communicated with the set of discharge channels (3) through the sets of front discharge ports (44 *a*, 44 *b*, 44 *c*) of the cylinders (40 *a*, 40 *b*, 40 *c*) (see FIGS. 2 and 5). In this way, the pressurized fluid contained inside the lifting chambers (241, 242, 240) will be discharged into the set of discharge channels (3) and from the set of discharge channels (3) it is able to freely flow out of the hammer through the channels (97) cooperatively formed between the splines (93) of the drill bit shank (95) and splines (112) of the driver sub (110), and through the flushing passages (92) of the drill bit (90) to the front face (99) of the drill bit (90).

Figure 6:
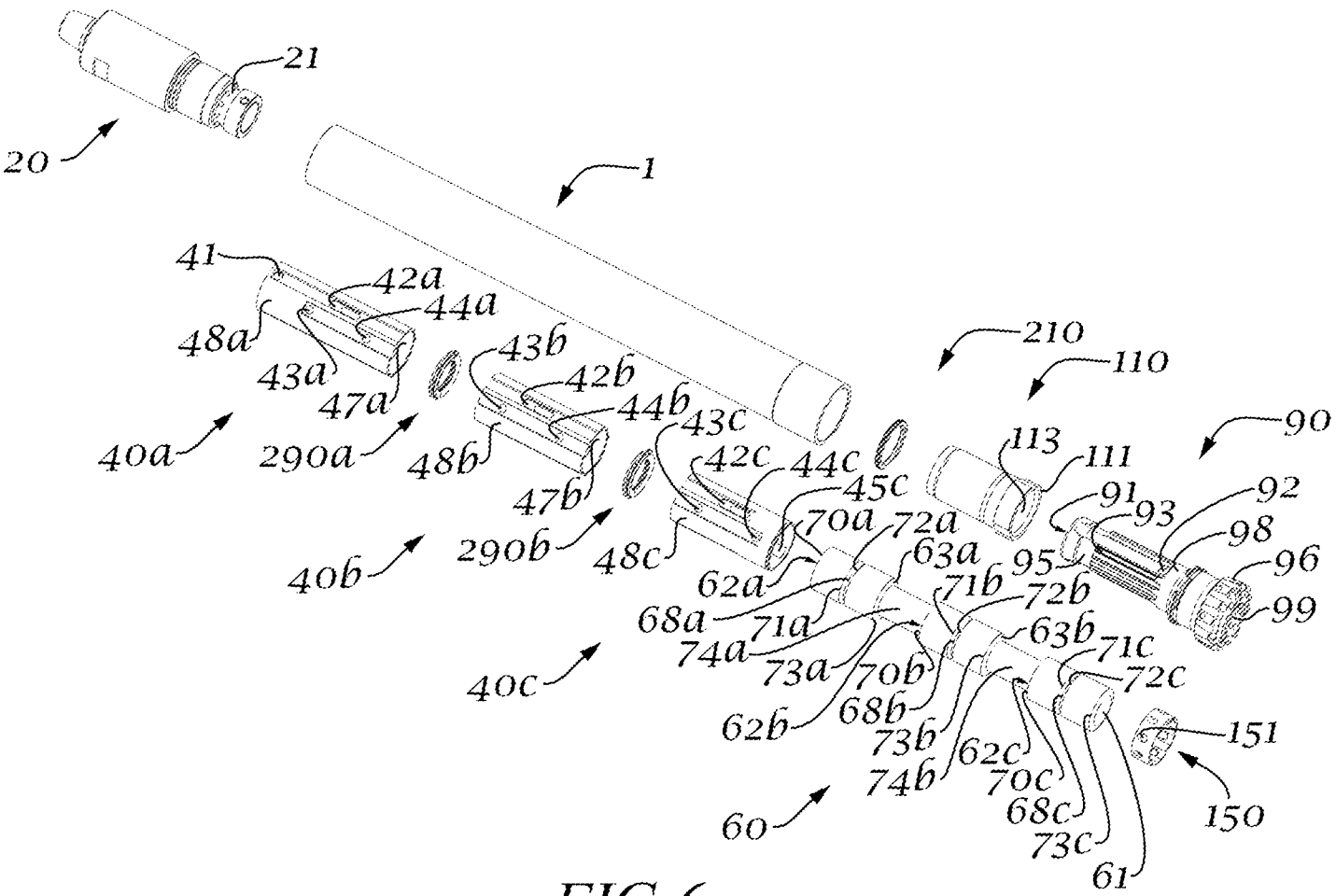
FIG. 6 depicts, in an exploded view, all the parts of the normal circulation DTH drill hammer according to the invention for a best understanding of the different features of these elements.

Normally, the drill bit (90) is aligned to the outer casing (1) of the hammer by a drill bit guide (150) having discharge grooves (151) as shown in the Figures (see particularly FIG. 6). In the current invention these discharge grooves connect the set of discharge channels (3) with the channels (97), so that the discharge of pressurized fluid flows through these discharge grooves (151) before reaching the channels (97) and thereafter flows through the flushing passages (92) of the drill bit (90). However, the invention is not limited to the use of a drill bit guide and alternative alignment solutions may be used with corresponding pressurized fluid discharge means.

Control of the State of the Drive Chambers (230, 231, 232)

Figure 5:
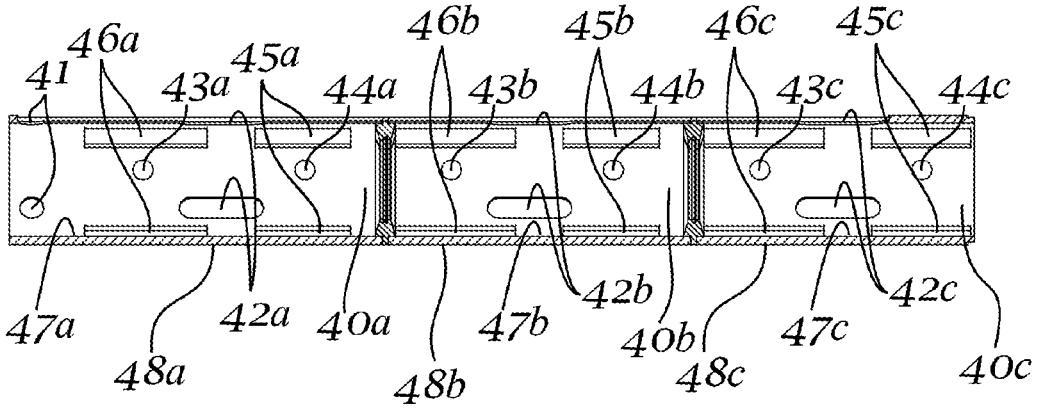
FIG. 5 depicts a cross section view of the cylinders and seals array of FIG. 4 for a best understanding of the different features of these elements.

When in the hammer cycle the impact face (61) of the piston (60), which is part of the main lifting surface (63 *c*), is in contact with the impact face (91) of the drill bit (90) and the drill bit (90) is at the rearmost point of its stroke, i.e. the hammer is at impact position (see FIG. 1), the drive chambers (230, 231, 232) are in direct fluid communication with the set of discharge channels (3) respectively through the sets of rear discharge ports (43 *a*, 43 *b*, 43 *c*) of the cylinders (40 *a*, 40 *b*, 40 *c*) (see FIGS. 1 and 5). In this way, the pressurized fluid contained inside the drive chambers (230, 231, 232) will be discharged into the set of discharge channels (3) and from the set of discharge channels (3) out of the hammer and to the front face (99) of the drill bit (90) in a similar fashion as with the pressurized fluid discharged from the lifting chambers (241, 242, 240).

This flow of pressurized fluid will stop when the piston (60) has traveled in the front end to rear end direction of its stroke until the rear outer discharge edges (70 *a*, 70 *b*, 70 *c*) of piston (60) reaches respectively the rear limit of the sets of rear discharge ports (43 *a*, 43 *b*, 43 *c*) of the cylinders (40 *a*, 40 *b*, 40 *c*). As the movement of the piston (60) continues further in the front end to rear end direction of its stroke, a point will be reached where the rear outer supply edges (71 *a*, 71 *b*, 71 *c*) of the piston (60) matches respectively the front limit of the rear sets of recesses (46 *a*, 46 *b*, 46 *c*) of the cylinders (40 *a*, 40 *b*, 40 *c*) (see FIGS. 2 and 5). As the movement of the piston (60) continues even further, the drive chambers (230, 231, 232) of the hammer will respectively become fluidly communicated with the supply chambers (68 *a*, 68 *b*, 68 *c*) through the rear sets of recesses (46 *a*, 46 *b*, 46 *b*) of the cylinders (40 *a*, 40 *b*, 40 *c*). In this way, the drive chambers (230, 231, 232) will be supplied with pressurized fluid coming from the supply chambers (68 *a*, 68 *b*, 68 *c*).

Flushing Mode Operation

If the hammer is lifted in such a way that the drill bit (90) stops being in contact with the rock being drilled and the drill bit's retainer supporting shoulder (94) rests on the drill bit retainer (210), the drill bit (90) will reach the front end of its stroke and then the hammer switches to its flushing mode. In this position the percussion of the hammer stops, hence leaving the impact face (61) of the piston (60) resting on the impact face (91) of the drill bit (90) (see FIG. 3 for illustration of the flushing mode description while features (61) and (91) are shown in FIG. 2), and the pressurized fluid is conveyed directly to the front end of the drill bit (90) through the following pathway: into the set of supply channels (2) through the supply undercut (21) of the rear sub (20) and the rear pressurized fluid intake ports (41) of the rearmost cylinder (40 *a*), and from the set of supply channels (2) to the set of discharge channels (3) respectively through the set of exit ports (42 *a*, 42 *b*, 42 *c*) of the cylinders (40 *a*, 40 *b*, 40 *c*), through the drive chambers (230, 231, 232), and through the sets of rear discharge ports (43 *a*, 43 *b*, 43 *c*) of the cylinders (40 *a*, 40 *b*, 40 *c*). From the set of discharge channels (3) the pressurized fluid is able to freely flow out of the hammer and to the front face (99) of the drill bit (90) in a similar fashion as with the pressurized fluid discharged from the lifting chambers (241, 242, 240) and drive chambers (230, 231, 232) when the hammer is in drilling mode.

The invention claimed is:

1. A pressurized fluid flow system for a down the hole drill hammer, CHARACTERIZED in that the hammer has a cylindrical outer casing, a rear sub affixed to the rear end of the outer casing for connecting the hammer to a source of pressurized fluid, a piston slidably and coaxially disposed for reciprocating movement inside the outer casing, and a drill bit slidably mounted on a driver sub in the front end of the hammer, the pressurized fluid flow system comprising:

a main lifting chamber and a main drive chamber located at opposite ends of the piston for causing the reciprocating movement of the piston due to the changes in pressure of the pressurized fluid contained therein;

a set of cylinders including at least one rearmost cylinder and one forwardmost cylinder, wherein the cylinders are arranged longitudinally in series and coaxially disposed in between the outer casing and the piston, and wherein the cylinders are separated from each other by seals;

a set of auxiliary lifting chambers and auxiliary drive chambers for likewise causing, in conjunction with the main lifting chamber and the main drive chamber, the reciprocating movement of the piston due to the changes in pressure of the pressurized fluid contained therein, wherein the auxiliary lifting and drive chambers are respectively located at each side of said seals and are formed by respective waists machined around the piston;

a set of supply chambers, wherein the supply chambers are defined by annular recesses on the external surface of the piston, and wherein the supply chambers are disposed in permanent fluid communication with the source of pressurized fluid and filled with the same when the piston is reciprocating;

one or more supply channels formed in between the outer casing and the cylinders, wherein the supply channels are in permanent fluid communication with the source of pressurized fluid and filled with the same when the hammer is operative;

one or more discharge channels formed in between the outer casing and the cylinders, wherein the discharge channels are in permanent fluid communication with the bottom of the hole when the hammer is operative;

wherein the cylinders have: a front set of recesses, and a rear set of recesses on their inner surfaces for respectively connecting the supply chambers with the lifting chambers and with the drive chambers when these must be supplied with pressurized fluid; a set of front discharge ports, and a set of rear discharge ports for respectively discharging pressurized fluid from the lifting chambers and drive chambers to the discharge channels; a set of exit ports for connecting the supply channels with the supply chambers; and wherein the rearmost cylinder has: a set of intake ports that connect with the source of pressurized fluid.

2. A normal circulation down the hole drill hammer, CHARACTERIZED in that the hammer comprises:

the pressurized fluid flow system of claim 1, wherein the bit has splines on the outer surface thereof and channels formed between the splines, wherein the channels are covered by the driver sub and wherein the bit further has flushing holes for connecting the channels formed between the splines with the bottom of the hole; and a drill bit guide having one or more apertures that connect the discharge channels with the channels formed between the splines of the drill bit.

* * * * *